United States Patent [19]

Clabby

[11] 4,140,244

[45] Feb. 20, 1979

[54] DISPOSABLE RAZOR DISPENSER

[76] Inventor: Merlyn L. Clabby, 1798 N. San Antonio Ave., Upland, Calif. 91786

[21] Appl. No.: 874,785

[22] Filed: Feb. 3, 1978

[51] Int. Cl.[2] ..... B65D 83/00; B65D 65/32; B65D 71/00; A47F 1/08

[52] U.S. Cl. ..... 221/281; 206/356; 206/45.33; 206/228; 312/42; 211/49 D

[58] Field of Search ..... 221/281, 282, 197; 211/49 D; 206/45.33, 356, 228, 352; 312/42

[56] References Cited

U.S. PATENT DOCUMENTS

| | | | |
|---|---|---|---|
| 1,054,707 | 3/1913 | Mertens | 211/490 |
| 2,330,639 | 9/1943 | Testi | 206/352 |
| 2,969,140 | 1/1961 | Avetta | 206/349 |
| 3,735,860 | 5/1973 | Nisson | 206/349 |
| 3,754,326 | 8/1973 | Glaberson | 206/228 |
| 3,970,194 | 7/1976 | Iten | 206/228 |
| 4,043,035 | 8/1977 | Pentney | 206/356 |

*Primary Examiner*—Allen N. Knowles

*Attorney, Agent, or Firm*—Shoemaker and Mattare, Ltd.

[57] ABSTRACT

A dispenser for disposable razors having a housing which is mountable for conveniently storing and dispensing disposable razors. The housing stores a plurality of disposable razors in a stacked configuration with the handles of such disposable razors presented outwardly to be easily grasped and removed from the housing. Also disclosed is a disposable razor package which maintains the disposable razors in an orientation convenient for insertion thereof into the disposable razor dispenser.

14 Claims, 10 Drawing Figures

FIG. 8.
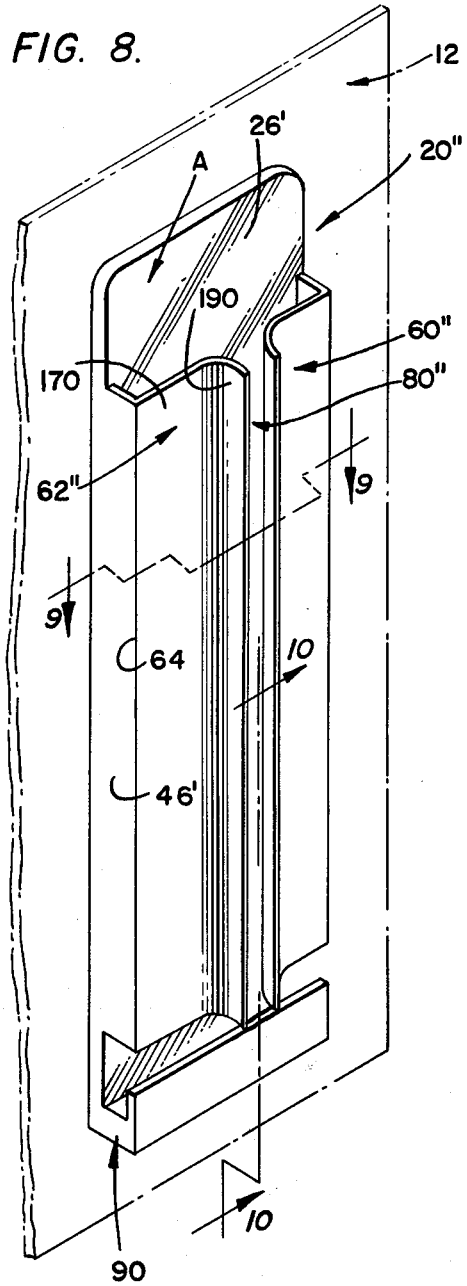
FIG. 9.
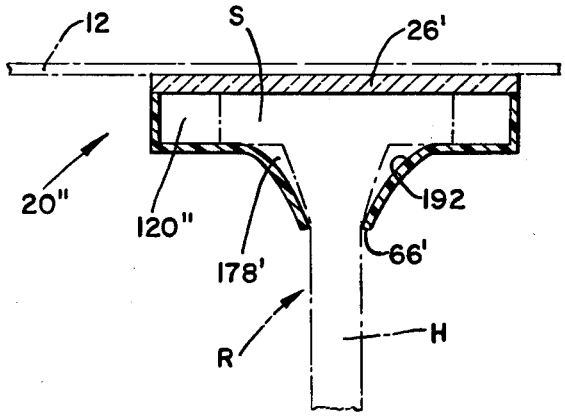
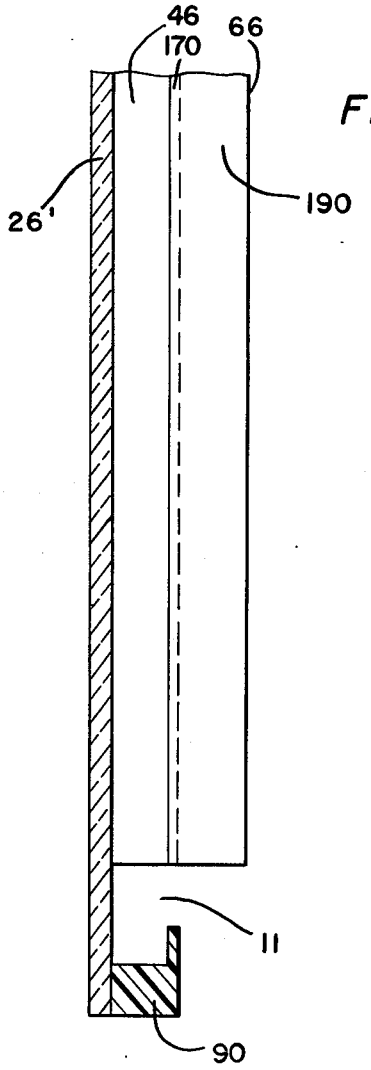
FIG. 10.

DISPOSABLE RAZOR DISPENSER

BACKGROUND OF THE INVENTION

The present invention relates, in general, to containers, and, more particularly, to dispensers for disposable razors.

The market for shaving equipment has undergone considerable changes in recent times. Devices in that market have developed from the simple razor blades which are disposed of after only a few uses to razor shaving heads which are disposed of after several uses, to an entire razor which is disposed of after several uses. The disposable razor is the most recent development in the shaving equipment market.

While dispensing devices associated with shaving devices have also undergone concommittant changes, from the blade dispenser to the shaving head dispenser, such development has stopped short of the equipment market, in that no dispensing device is available for the newly developed disposable razors. Thus, while devices such as those disclosed in U.S. Pat. Nos. 4,043,035, 3,970,194 and 3,754,326 for dispensing shaving heads, that device disclosed in U.S. Pat. No. 2,330,639 for dispensing blades, and that device disclosed in U.S. Pat. No. 3,735,860 for holding a razor, are suitable for some purposes, those devices fall far short of filling the requirements of convenience in selling, displaying and dispensing disposable razors. These known devices are especially deficient in providing a suitable storage arrangement for the disposable razors once a package of such razors has been opened.

While mountings for safety razors are known (see, for example, U.S. Pat. No. 2,969,140), the inventor is not aware of any device which can be mounted in a convenient location and which dispenses disposable razors. Thus, there is need for such a device if the dispensing market is to keep pace with the shaving equipment market.

The device disclosed herein satisfies this need.

SUMMARY OF THE INVENTION

The device embodying the teachings of the present invention stores and dispenses disposable razors in a convenient manner.

The basic dispenser includes a case which is designed to be secured to a wall and which has an open top to receive the disposable razors in hopper-like fashion. For dispensing, the razors are guided down a vertically oriented elongate trackway with the handles thereof protruding from a vertical slot running the length of the storage area and which forms the trackway. Each razor handle overlaps the handle of a subjacent razor to an extent required to minimize the amount of space required for the dispensing device. Each razor has a shaving head which includes a blade section, and such blade sections are positioned in stacked relationship in the dispenser.

Each razor is thus pendently supported and the handle thereof hands downwardly from the dispenser. The weight of the handle exerts a very slight pull on the shaving head against the front and back walls of the case and helps keep the razors in proper alignment in the dispenser. The razors slip down the slot with the handles thereof protruding until they reach a retainer shelf located adjacent the bottom of that slot. The shelf is spaced from the slot to define a dispensing slot, and maintains the razors in a dispensing presentation. Individual razors are then released by pushing each razor sideways, or horizontally, through the dispensing slot. The dispensing slot is sized to permit the razor head to freely slide, yet is only large enough for the handle to slip through. Such sizing keeps the razors from sliding out of the container.

A package of disposable razors can be purchased and used to reload the dispenser.

The package may contain as many as five or six disposable razors which may be packed with the shaving heads lined up one behind the other and with the handles overlapping, much as they would be in the dispenser. The razors are kept in line with a thin cardboard backing along the face of the razor shaving heads, and a thin pliable plastic ribbon tied around the handles. The plastic ribbon around the handles may be attached to the carboard backing, and when such a strip is broken, the razors are released to fall down the slot in the dispenser.

The dispenser can also be used as part of a promotion for the razors themselves, and therefore actually contributes tc the disposable razor market in addition to the above-discussed features.

Accordingly, using the dispensing device herein-disclosed, a suitable supply of dispensable razors is always maintained in a convenient location. Furthermore, the device is handy and convenient to use and easily attachable to a wall, such as a bathroom wall. The device is inexpensive to manufacture, and therefore can be marketed easily. The device is ideally suited for an injection molding process, thereby further expediting manufacture thereof.

The device is amenable for use as a product display so that disposable razors can be placed in the dispenser, thereby producing an attractive sales package, thus further assuring benefits of mass production and distribution.

OBJECTS OF THE INVENTION

It is, therefore, a main object of the present invention to provide a convenient means for dispensing disposable razors.

It is another object of the present invention to provide a convenient means for storing disposable razors.

It is a further object of the present invention to provide a replenishable disposable razor storage means.

It is yet another object of the present invention to provide a means for displaying disposable razors.

It is still a further object of the present invention to provide a means for packaging disposable razors in an orientation so that such disposable razors are easily transferred to the dispensing means embodying the teachings of the present invention.

These together with other objects and advantages which will become subsequently apparent reside in the details of construction and operation as more fully hereinafter described and claimed, reference being had to the accompanying drawings forming part hereof, wherein like reference numerals refer to like parts throughout.

BRIEF DESCRIPTION OF THE DRAWINGS

FIG. 8 is a perspective view of yet another form of the disposable razor dispensing device embodying the teachings of the present invention.

FIG. 9 is a view taken along line 9—9 of FIG. 8.

FIG. 10 is a view taken along line 10—10 of FIG. 8.

DETAILED DESCRIPTION OF THE INVENTION

Figure 1:
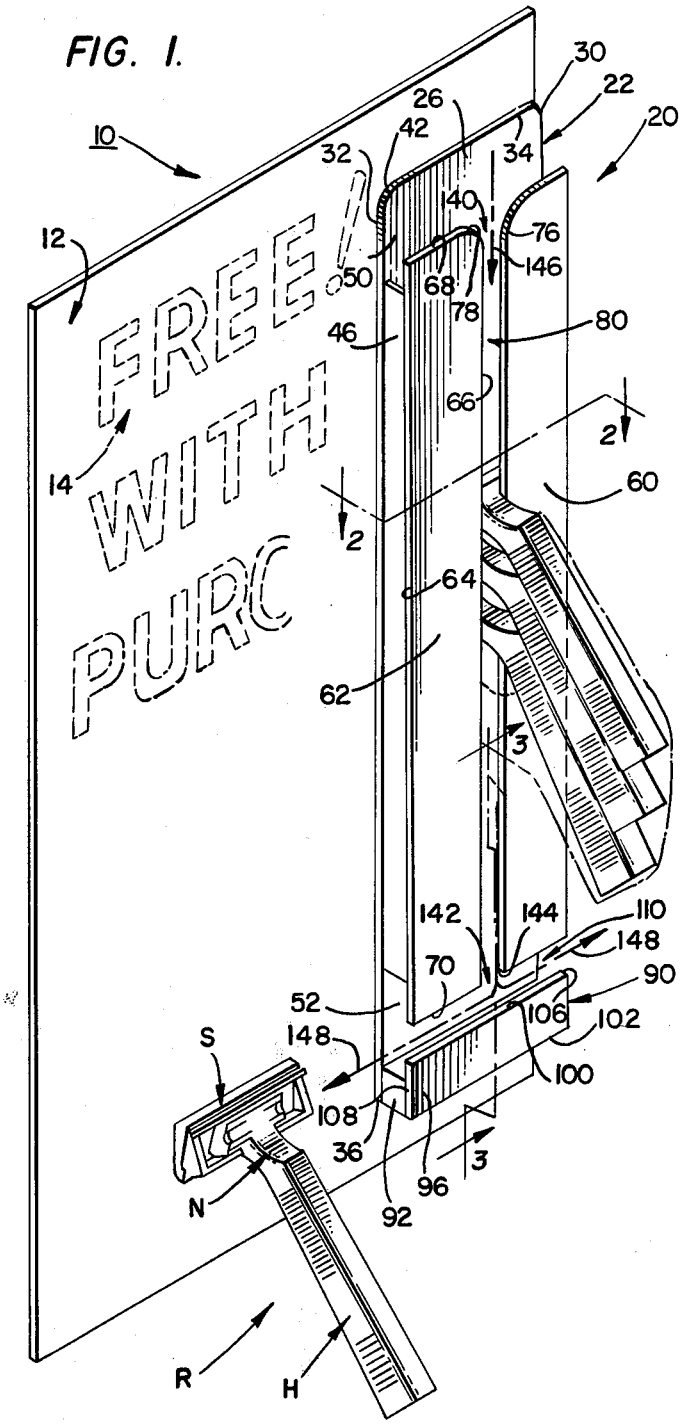
FIG. 1 is a perspective view of one form of the disposable razor dispensing device embodying the teachings of the present invention.

Shown in FIG. 1 is a disposable razor display 10 which includes a display backing member 12 having merchandising information 14 thereon. The backing member 12 can be a wall exhibitor, counter stand-up card, or the like, and can contain a wide variety of information, such as price, sales promotion information, and the like.

Figure 2:
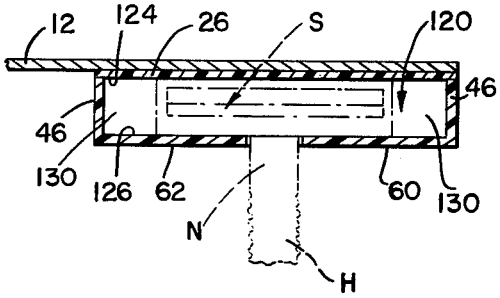
FIG. 2 is a view taken along line 2—2 of FIG. 1.
Figure 3:
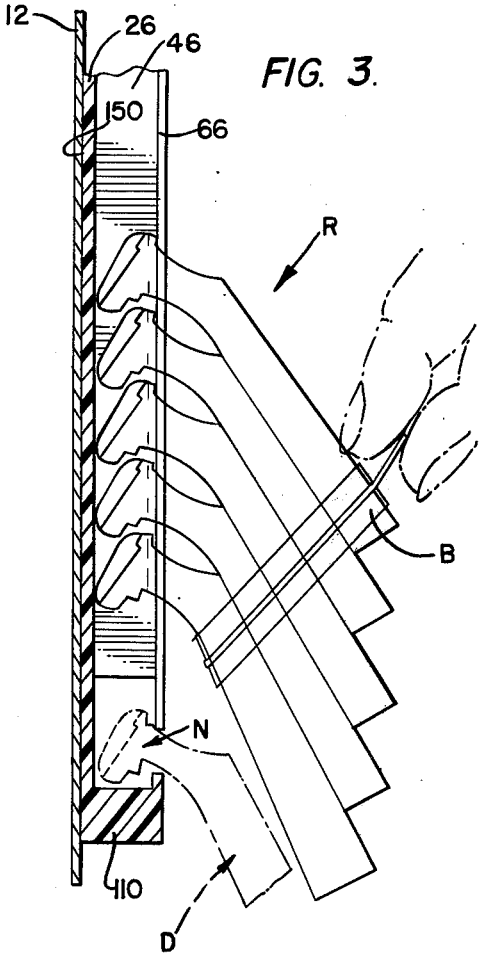
FIG. 3 is a view taken along line 3—3 of FIG. 1.

A disposable razor dispenser 20 embodying the teachings of the present invention is affixed to the backing member and one form of the dispenser is shown in FIGS. 1-3 to include a frame 22 which has an elongate back 26 releasably mounted on the backing member. The back 26 includes longitudinal side edges 30 and 32, end edges 34 and 36 of which edge 34 is shown in FIG. 1 to be a top edge and edge 36 is shown in FIG. 1 to be a bottom edge of the back 26. As shown, the back has arcuate corners 40 and 42 at the intersection of the longitudinal edges and the top edge.

A pair of elongate side panels are edge mounted on the back 26 adjacent the longitudinal side edges thereof. Both side panels are identical, and, as shown in FIG. 1, side panel 46 is mounted to be perpendicular to the plane of the back and to be located between the top and bottom edges thereof. The side panels extend along the longitudinal side edges and are shorter in extent than such side edges, as shown in FIG. 1 to define a top margin 50 and a bottom margin 52 adjacent top and bottom edges 34 and 36, respectively.

A pair of spaced, coplanar front members 60 and 62 are each mounted on a corresponding side panel to be in spaced parallelism with the dispenser back 26. As shown in FIG. 1, the front members each have longitudinal side edges 64 and 66, and side edges 68 and 70, of which side edges 68 form top top edges and side edges 70 form bottom edges, longitudinal side edges 64 forming outer edges and longitudinal side edges 66 forming inner edges. Arcuate corners 76 and 78 are formed at the intersection of the inner edges 66 and the top edges 58, and the longitudinal side edges 66 are spaced apart to define a slot 80 therebetween. As will be discussed below, the slot 80 is elongate and forms a track through which disposable razors are guided.

Still referring to FIG. 1, the dispenser 20 further includes a limit stop or retainer shelf 90 having an elongate base 92 mounted on the back 26 adjacent the bottom edge 36 thereof to be coextensive with such edge. A facing plate 96 is attached to the base 92 to be in spaced parallelism with the back 26 and to be coextensive with bottom edge 36. The facing plate 96 has longitudinal edges 100 and 102 which form top and bottom edges, respectively, and end edges 106 and 108 which form the side edges of the facing plate and which are aligned with back edges 30 and 32, respectively. The facing plate has a transverse extent from back bottom edge 36 toward the front member bottom edges 70 to a location spaced apart from such bottom edges to define an elongate dispensing slot 110 with such bottom edges.

The disposable razors R are stored in the slot 80 in imbricated fashion and each razor includes the usual handle H, neck N and shaving head S. The longitudinal side edges 64 of the front members are horizontally aligned and are spaced apart a distance sufficient to accomodate the razor neck N in a free sliding manner.

Figure 7:
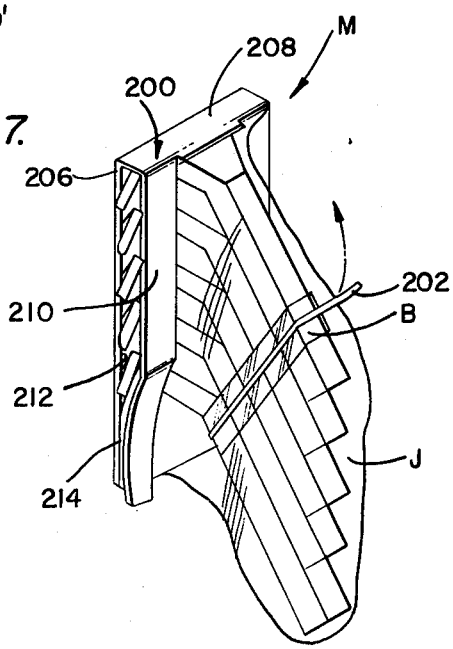
FIG. 7 is a perspective view of a package for storing disposable razors in an orientation convenient for use with the dispensing device embodying the teachings of the present invention.

As shown in FIGS. 3 and 7, the razors R can be purchased in magazine form with a band B tieing the nested razors together, and a jacket J encasing the cluster of razors to form a protector therefor.

As shown in FIG. 2, the spaced nature of the frame elements of the dispenser form a channel 120 which has a transverse width sufficient to receive razor head S in free sliding contact with inner surfaces 124 and 126 of the back 26 and the front members, respectively. The channel also has a transverse length greater than the length of the razor head S thus forming gaps 130 adjacent either end edge of that razor head.

The operation of the dispenser is shown in FIGS. 1 and 3. The razors are loaded into the dispenser via an entranceway 140 defined between the arcuate corners 76 and 78 and moved down the slot 80 toward an exitway 142 defined by bottom corners 144 of the front members as indicated by arrow 146. The width of the dispensing slot slightly exceeds the thickness of the razor necks N so the razors can be moved outwardly from the slot as indicated by arrows 148 in FIG. 1.

As each razor is removed from the dispensing slot, the other superjacent razors gravitate downwardly to force the next superjacent razor into the dispensing slot in dispensing position. A razor in such dispensing position is shown in FIG. 3 and indicated by the reference indicator D. The handle of razor D hangs downwardly from the dispensing slot to be in an easily grasped presentation.

The back 26 forms a mounting base of the in-use dispenser and has a rear surface 150 which is affixed to a wall by suitable means, such as adhesive or the like, to orient the dispenser in a convenient location therefor. The adhesive can be placed on the back prior to sale, or just prior to use, as is suitable. As shown in the Figures, the razors are supported in an orientation which prevents damage to the blades thereof during the dispensing process. It is noted that the channel 120 is sized to be large enough to allow the razors to slide, yet small enough to eliminate play in the razors which might damage those devices. As is evident from the foregoing description, the razors R are replenishable and the dispenser can be reloaded in situ with individual razors or magazines thereof as suitable.

Figure 4:
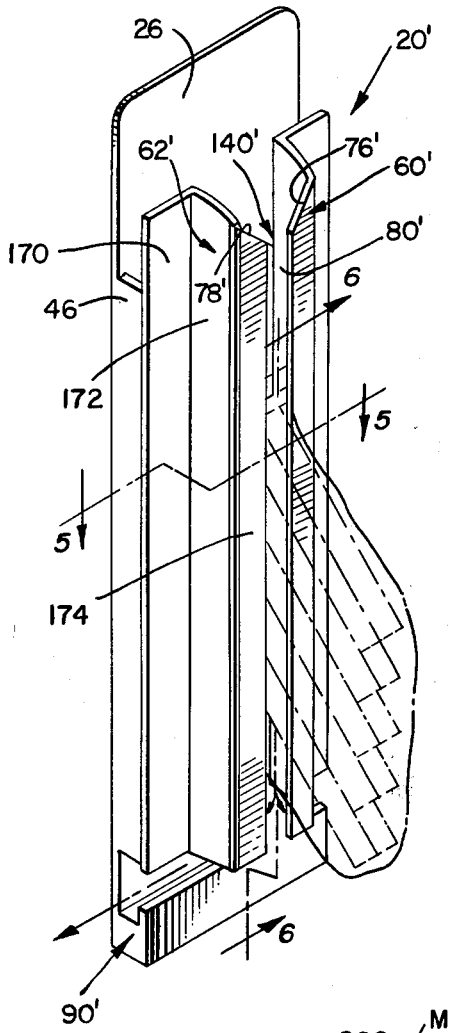
FIG. 4 is a perspective view of another form of the disposable razor dispensing device embodying the teachings of the present invention.
Figure 5:
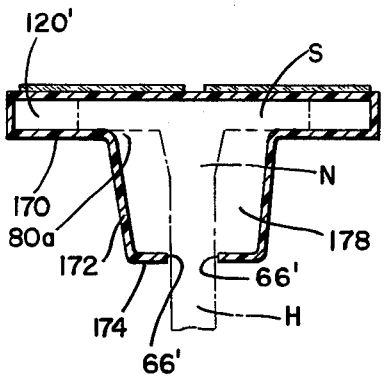
FIG. 5 is a view taken along line 5—5 of FIG. 4.
Figure 6:
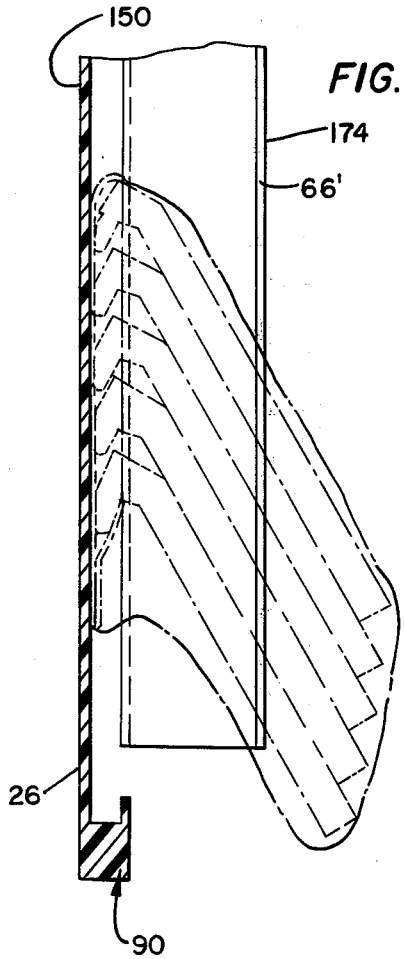
FIG. 6 is a view taken along line 6—6 of FIG. 4.

An alternative form of the disposable razor dispenser is shown in FIGS. 4-6 and is indicated by the numeral 20'. The dispenser 20' also includes a back 26 and has side panels, such as side panel 46, attached thereto as in the dispenser 20. Furthermore, the retainer shelf 90' of the dispenser 20' is similar to the retainer shelf 90 except that the shelf 90' is a one-piece construction.

The front members 60' and 62' of the dispenser 20' are unitary and each includes a first planar portion 170 attached to a side panel to be in spaced parallelism with the back 26 and to extend inwardly of the back toward the other planar portion. Each front member further includes a second planar portion 172 attached to the first planar portion at a location remote from the side panels and which is inwardly inclined toward the center of the back, as indicated in FIG. 5. Each front member further includes a return bend 174 which forms a third planar portion of the unitary front member and is connected to the second planar portion to be in spaced parallelism with the back 26 as shown in FIG. 5.

As best shown in FIG. 5, the front members form a pair of channels, including a first channel 120' which corresponds to channel 120 of dispenser 20 and a second channel 178. As in dispenser 20, the razor head S is accommodated in sliding engagement in channel 120' and the razor neck portion N and part of the razor handle H is positioned in the channel 178. It is noted that inner longitudinal edges 66' correspond to the longitudinal edges 66 of the dispenser 20 and define therebetween a slot 80' which is sized to receive the handles H of the razors R in a free sliding manner and has an entranceway 140' defined therein by sloping edges 76' and 78' of the planar portions 174. Thus, slot 80' is slightly different in size from slot 80 due to the different portion of the razors R accommodated therein. It is further noted that due to the presence of channel 178, channel 120' differs slightly from channel 120 by having an opening **80*a* which differs in dimensional extent from slot 80 of the dispenser 20**.

The operation of dispenser 20' is identical to that of dispenser 20, and accordingly, will not be further described.

Yet another form of the disposable razor dispenser is shown in FIGS. 8–10 and is indicated by the reference numeral 20''. The dispenser 20'' is similar to dispenser 20' with the exception of the front members. The front members 60'' and 62'' of dispenser 20'' each include a first planar portion 170' and a crescent-shaped arcuate portion 190 which is facially opposed with the corresponding crescent-shaped arcuate portion on the other front member. The arcuate portions 190 are located on longitudinal edges of the first planar portion which edges are remote from longitudinal edges 64' of the front members. It is noted that the side panels, such as side panel 46', can be integral and unitary with the front members in the dispenser 20''. If desired, a mirror A can be located on the back 26' of the dispenser as shown in FIG. 9. Such mirror makes the dispenser even more amenable for use in a bathroom.

As shown in FIG. 9, the dispenser 20'' has a pair of channels which include a first channel 120'' corresponding to channel 120' of dispenser 20', and a second channel 178' connected thereto. As in dispenser 20', the channel 120'' differs slightly from channel 120'. The crescent-shaped portions 190 each has an inner surface 192 which contacts the razor at the handles adjacent the neck portions thereof at a location near the inner longitudinal edges 66' of the front members as defined by the free longitudinal edges of the crescent-shaped portions. The crescent-shaped portions thus define an elongate slot 80'' which accomodates the razors in a free sliding manner as in the dispensers 20 and 20'.

Again, the operation of dispenser 20'' is identical to that of dispensers 20 and 20', and thus will not be further described.

A magazine of disposable razors is shown in FIG. 7 as is indicated by the indicator M. As shown in FIG. 7, the razors are contained in a tearable jacket or bridle 200 in piggyback fashion within jacket J. The razors are tied together by the band B and the jacket includes a tear strip 202 for opening such jacket. The tear strip can also be connected to the band to open that band at the same time jacket J is opened. The bridle includes a back 206, a top 208 and sides 210 which are releasably attached to top surface 212 of the back at locations 214 on the sides. To load the razors of magazine M into one of the dispensers, the bridle is torn off, the tear strip 202 released and the jacket J removed. The razors are then introduced into the dispensers as aforediscussed. The tear strip and/or the band can be formed of a pliable plastic material, and the bridle may be cardboard or other such material. Part of the jacket J can be interposed between the sides 210 and the back so that when the jacket is removed, the bridle is torn open to release the razors. In such a structure, adhesive, or the like, would be positioned on the jacket so that the sides 210 are connected to the back 206 via the jacket J. Thus, when the jacket is opened, the bridle is automatically opened to release the razors.

An alternative form of such opening means includes interpositioning of a portion of either the tear strip or band between the sides and the back 206 with adhesive, or the like, thereon, so that the sides are connected to the back via the strip and/or band, and removal of the strip or band breaks the bond between the sides and the back to open the bridle.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. A device for dispensing disposable razors comprising:

a housing having a back, sides and a front, said front having an elongate slot defined therein for slidably accomodating disposable razors in a stacked configuration;

a retainer shelf mounted on said back to be located adjacent said slot, said shelf being positioned to support a disposable razor thereon while such razor is accomodated in said slot;

entranceway defining means on said housing front for receiving disposable razors and guiding such disposable razors into said slot; and lateral dispensing slot defining means on said retainer shelf for guiding disposable razors out of said elongate slot and out of said housing;

said housing front, sides and back defining a chamber in which the heads of disposable razors are positioned so that the handles of such disposable razors extend outwardly of said chamber through said elongate slot into an orientation wherein said handles can be grasped for moving a disposable razor through said elongate and dispensing slots.

2. The device defined in claim 1 wherein a plurality of disposable razors are stored in said housing with the handles of such disposable razors extending outwardly of said housing via said elongate slot and being in an imbricated orientation.

3. The device defined in claim 1 further including adhesive on said housing back for attaching said housing to a wall.

4. The device defined in claim 1 wherein said housing front includes a pair of front members each having a longitudinal edge and being spaced apart and oriented with said longitudinal edges facing each other to define said elongate slot between said facing longitudinal edges.

5. The device defined in claim 1 wherein said housing front includes a pair of front members each including a first planar portion attached to a housing side, a second planar portion attached to said first planar portion at a location remote from said housing side, and a third planar portion attached at one edge thereof to said second planar portion to extend in a direction common to a plane containing said housing back, the other edges of said third planar portions being presented toward each other and spaced apart to define said elongate slot.

6. The device defined in claim 5 wherein said elongate slot is sized to accomodate a handle of a disposable razor so that such razor freely slides within said elongate slot.

7. The device defined in claim 1 wherein said housing front includes a pair of front members each including a first planar portion attached to a housing side, and an arcuate portion attached to said first planar portion and having a razor engaging surface thereon, said arcuate portions being attached to said first planar portions so that said razor engaging surface are presented toward each other and spaced apart to define said elongate slot.

8. The device defined in claim 7 wherein said elongate slot is sized to accomodate a handle of a disposable razor so that such razor freely slides within said elongate slot.

9. The device defined in claim 4 wherein said front members are spaced from said housing back a distance sufficient such that said elongate slot defining longitudinal edges engage a disposable razor at a location closely adjacent the head of such disposable razor.

10. The device defined in claim 5 wherein said third planar portions are spaced from said housing back a distance sufficient such that said elongate slot defining longitudinal edges engage a disposable razor handle at a location spaced apart from the head of such disposable razor.

11. The device defined in claim 7 wherein acruate portions are spaced from said housing back a distance sufficient such that said elongate slot defining razor engaging surfaces engage a disposable razor handle at a location adjacent the neck of such disposable razor and spaced apart from the head of such disposable razor.

12. The device defined in claim 7 further including a mirror on said housing back.

13. A package for disposable razors comprising:

a band for extending around the handles of a plurality of disposable razors to tie such razors together in a stacked configuration;

a jacket surrounding tied together disposable razors; opening means on said jacket; and a bridle for releasably coupling together the heads of a plurality of stacked disposable razors, said bridle including a back, a top connected to said back and sides connected to said top to be coextensive with said back, said sides extending in a plane common to a plane containing said back and being spaced apart a distance sufficient to accomodate the neck portions of disposable razors, and attaching means for attaching said sides to said back at a location remote from said top to capture heads of disposable razors between said sides and said back.

14. The package of claim 13 wherein said jacket is associated with said attaching means in a manner such that opening said jacket by said opening means releases said sides from said back.

* * * * *